US008377220B2

(12) United States Patent
Kränzle et al.

(10) Patent No.: US 8,377,220 B2
(45) Date of Patent: Feb. 19, 2013

(54) DISHWASHER AND METHOD FOR OPERATING A DISHWASHER

(75) Inventors: Bernd Kränzle, Demmingen (DE); Pedro Sancho, Zaragoza (ES); Franz-Josef Wagner, Nördlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/537,095

(22) Filed: Jun. 29, 2012

(65) Prior Publication Data

US 2012/0266919 A1 Oct. 25, 2012

Related U.S. Application Data

(62) Division of application No. 12/674,722, filed as application No. PCT/EP2008/060974 on Aug. 21, 2008, now Pat. No. 8,268,088.

(30) Foreign Application Priority Data

Aug. 31, 2007 (DE) ..... 10 2007 041 313

(51) Int. Cl.
*B08B 7/04* (2006.01)

(52) U.S. Cl. ..... 134/18; 134/25.2; 15/1

(58) Field of Classification Search ..... None
See application file for complete search history.

(56) References Cited

U.S. PATENT DOCUMENTS

| | | | |
|---|---|---|---|
| 2006/0054198 | A1 | 3/2006 | Choi |
| 2007/0006899 | A1 | 1/2007 | Bang |
| 2007/0181156 | A1 | 8/2007 | Uz et al. |

FOREIGN PATENT DOCUMENTS

| | | | |
|---|---|---|---|
| CH | 694495 | A5 | 2/2005 |
| DE | 19857101 | A1 | 6/2000 |
| EP | 1088509 | A1 | 4/2001 |

OTHER PUBLICATIONS

International Search Report PCT/EP2008/060974, mailed Dec. 16, 2008.

*Primary Examiner* — Eric Golightly
(74) *Attorney, Agent, or Firm* — James E. Howard; Andre Pallapies

(57) ABSTRACT

A method for operating a dishwasher that has a washing container; at least two spray devices disposed inside the washing container; a circulating pump to deliver liquid to the at least two spray devices; a first drive to drive the circulating pump; and a reversing device; wherein, based on a position of the reversing device, the circulating pump delivers the liquid to one or both of the two spray devices. The method includes adjusting the position of the reversing device and detecting the current position of the reversing device based on an operating parameter assigned to the first drive.

8 Claims, 2 Drawing Sheets

DISHWASHER AND METHOD FOR OPERATING A DISHWASHER

CROSS-REFERENCE OF RELATED APPLICATIONS

This application is a Divisional, under 35 U.S.C. §121, of U.S. application Ser. No. 12/674,722, filed Feb. 23, 2010 and issued as U.S. Pat. No. 8,268,088 on Sep. 18, 2012, which is a U.S. national stage application under 35 U.S.C. §371 of PCT/EP2008/060974 filed Aug. 21, 2008, which designated the United States; this application also claims the priority, under 35 U.S.C. §119, of German Patent Application No. 10 2007 041 313.2 filed Aug. 31, 2007.

BACKGROUND OF THE INVENTION

The invention relates to a method for operating a dishwasher.

DE 198 57 101 B4 discloses a dishwasher comprising a washing container (tub), a circulating pump, two spray arms disposed in the washing container, which spray arms can be supplied with washing liquid by means of the circulating pump, a throughflow heater connected in circuit downstream of the circulating pump, and a reversing device. The reversing device is driven by a drive having a motor in such a way that one of the spray arms at a time, neither of the spray arms or both spray arms can be supplied with the washing liquid. A microswitch for controlling the drive can detect the position of the reversing device.

BRIEF SUMMARY OF THE INVENTION

The object of the invention is to disclose a method for operating a dishwasher which permits the current position of the reversing device to be detected in a relatively simple manner.

A further object of the invention is to disclose a correspondingly embodied dishwasher.

The object of the invention is achieved by means of a method for operating a dishwasher, said method comprising the following steps:

Adjusting the position of a reversing device of a dishwasher which, in addition to the reversing device, has a washing container, at least two spray devices disposed inside the washing container, a circulating pump for delivering liquid to the spray devices, and a first drive for driving the circulating pump, wherein the circulating pump delivers liquid to one of the two spray devices and/or to both spray devices according to the position of the reversing device, and detecting the current position of the reversing device on the basis of at least one operating parameter that is assigned to the first drive.

The further object of the invention is achieved by means of a dishwasher, comprising a washing container, at least two spray devices disposed inside the washing container, a circulating pump for delivering liquid to the spray devices, a first drive for driving the circulating pump, a reversing device on the basis of the position of which the circulating pump delivers liquid to one of the two spray devices and/or to both spray devices, and a control device for controlling and/or regulating the first drive. The control device is configured to detect the current position of the reversing device on the basis of at least one operating parameter assigned to the first drive.

The dishwasher according to the invention has the washing container inside which the at least two spray devices are disposed. Spray devices are, for example, generally known spray arms to which the circulating pump delivers liquid, which is generally referred to as washing liquor, during the operation of the dishwasher. In the course of the wash program provision is normally made to supply e.g. only one of the two spray devices with the liquid, in particular alternately, during a wash subprogram. It can, however, also be provided to supply both spray devices with the liquid.

To ensure the circulating pump delivers liquid to the desired spray device, the dishwasher according the invention includes the reversing device, which is also referred to as a water distributor. Reversing devices as such are known e.g. from the patent specification DE 198 57 101 B4 cited in the introduction and are disposed between the circulating pump and the spray devices. A reversing device comprises e.g. a valve body which can be adjusted for example by means of a drive, in particular by mean of an electric drive, so that liquid conveyed by the circulating pump is delivered to the desired spray devices.

Depending on the position of the reversing device, therefore, the circulating pump delivers liquid accordingly to the spray devices. A corresponding hydraulic load is generated at the circulating pump depending on to which of the spray devices the circulating pump delivers liquid. It is therefore provided according to the invention to detect the current position of the reversing device e.g. as a function of the hydraulic load at the circulating pump as the operating parameter assigned to the circulating pump. This is possible e.g. by means of an evaluation of the current hydraulic load at the circulating pump, generally by means of an evaluation of the operating parameter assigned to the circulating pump and/or to the first drive.

The circulating pump is driven by the first drive, which can be e.g. a first electric drive. In the case of the first electric drive the operating parameter can be an electric current, an electric voltage, an electric power output, a torque and/or a rotational speed of the electric drive. Since according to this variant the circulating pump is driven by the first electric drive, operating parameters of the first electric drive, such as in particular the just cited electric current or the electric power output of the first electric drive, will also change as a function of the hydraulic load at the circulating pump. Accordingly it is possible to make deductions about the current position of the reversing device on the basis of said operating parameters. The first electric drive comprises e.g. a converter or, as the case may be, an inverter and an electric motor.

According to an embodiment variant of the inventive method or, as the case may be, the inventive dishwasher, the operating parameter assigned to the first electric drive is also used for controlling and/or regulating the first electric drive. Thus, no special device for determining the operating parameter is required for the method according to the invention, since said parameter is already available for regulating and/or controlling the first drive driving the circulating pump.

The reversing device can be adjusted e.g. by means of a second drive, in particular by means of a second electric drive. In particular when the second electric drive is used to adjust the reversing device the control device of the dishwasher according to the invention can be configured in a relatively simple manner to control the second electric drive. The control device comprises e.g. a suitably programmed microprocessor.

According to a variant of the inventive method or, as the case may be, of the inventive dishwasher, the reversing device is adjusted until it is detected on the basis of the at least one operating parameter that the reversing device has assumed a desired position. This embodiment variant can be achieved in particular relatively simply by means of a corresponding embodiment of the control device of the inventive dishwasher, which control device controls the second drive in a suitable manner on the basis of the operating parameter.

According to an embodiment variant of the inventive method or, as the case may be, of the inventive dishwasher, during the adjustment of the reversing device the at least one operating parameter is compared with comparative values assigned to the individual positions of the reversing device in order to detect the current position of the reversing device on the basis of the at least one operating parameter. As already explained, the hydraulic load at the circulating pump, and hence the operating parameter, changes as a function of the position of the reversing device. Accordingly, corresponding hydraulic loads, and consequently also corresponding values of the operating parameter, can be assigned to the individual positions of the reversing device. Said values of the operating parameter are the comparative values which are stored e.g. in a memory of the dishwasher according to the invention. The control device of the dishwasher according to the invention is then configured for example in such a way as to compare the current operating parameter with the comparative values and at the same time to adjust the reversing device until the current operating parameter assumes the value of the comparative value which corresponds to the desired position of the reversing device.

Depending on the embodiment variant, advantages of the inventive method or, as the case may be, of the inventive dishwasher can be the following:

Because of the use of the operating parameter assigned to the circulating pump and/or to the first drive driving the circulating pump for the purpose of detecting the current position of the reversing device, no special feedback contact is required for detecting the current position of the reversing device. As a result an associated input e.g. for the control device is likewise not needed, thereby potentially enabling the dishwasher according to the invention to be manufactured at lower cost.

It is possible to switch only after the desired position of the reversing device has been reached. By this means variations in tolerance which can result due to the use of the feedback contact can be reduced.

BRIEF DESCRIPTION OF THE DRAWINGS

An exemplary embodiment of the invention is illustrated by way of example in the attached schematic drawings, in which.

DETAILED DESCRIPTION OF EXEMPLARY EMBODIMENTS OF THE PRESENT INVENTION

Figure 1:
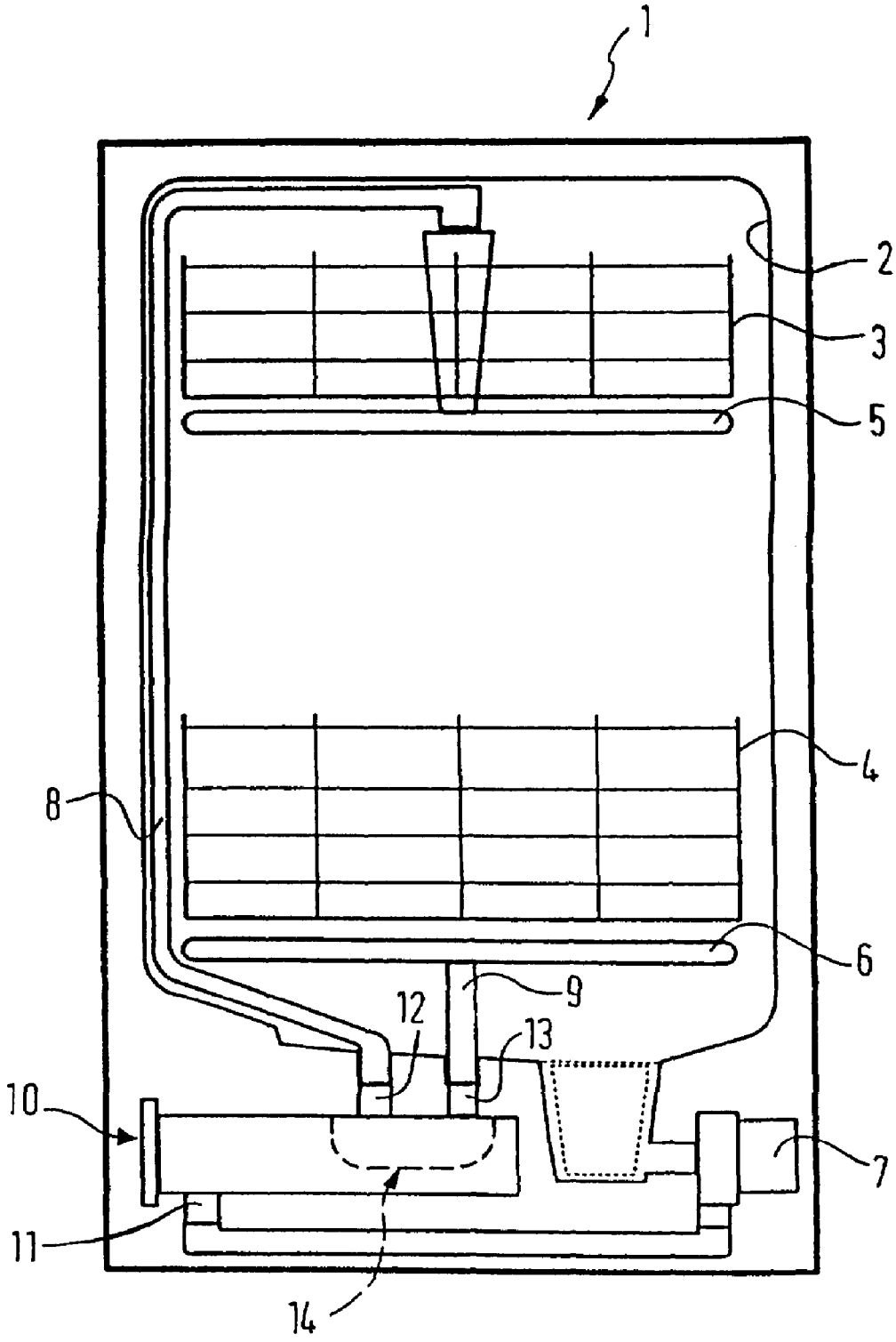
FIG. 1 shows a dishwasher.
Figure 2:
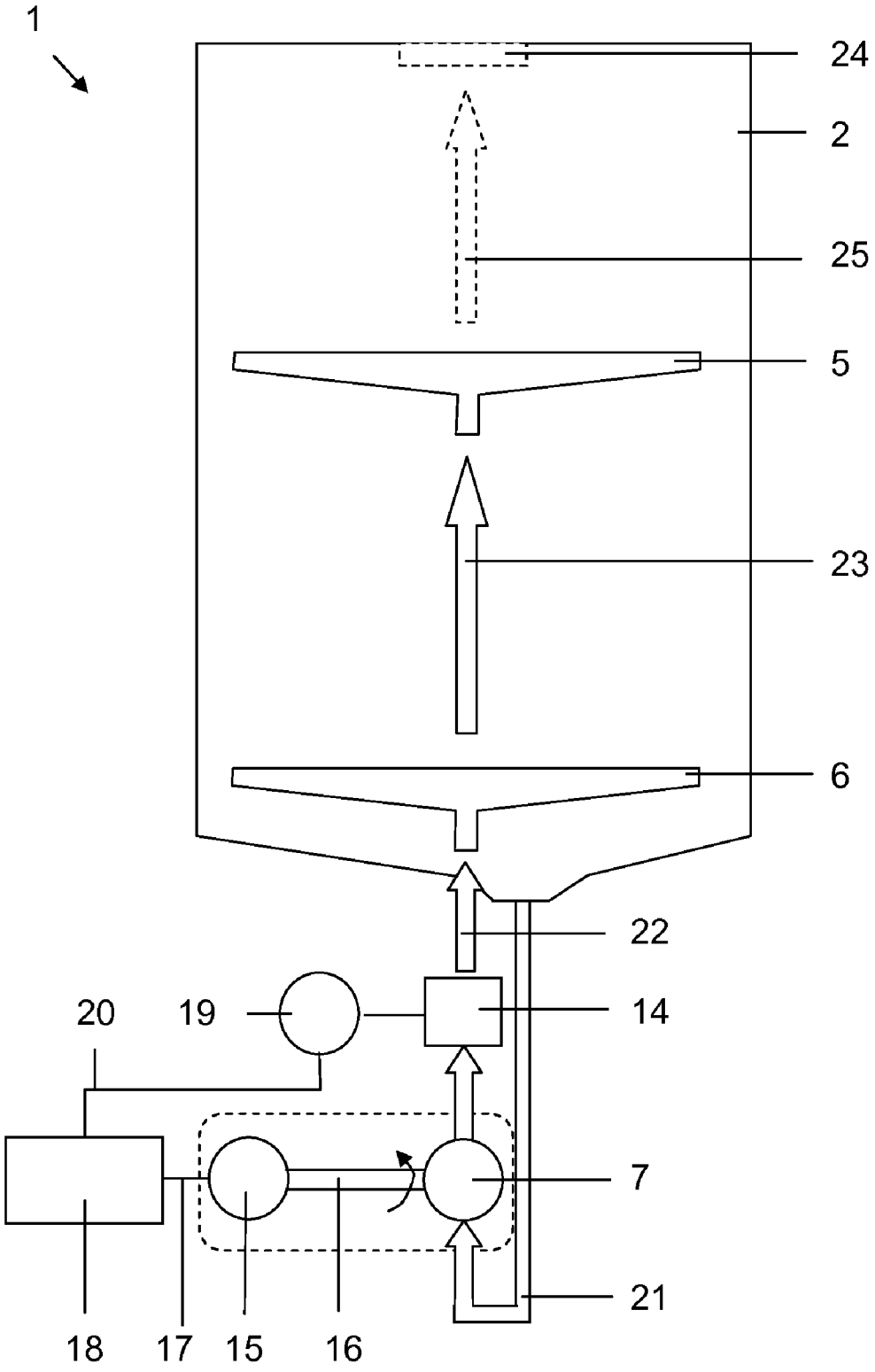
FIG. 2 is a schematic diagram of the dishwasher.

FIG. 1 shows a dishwasher 1 and FIG. 2 shows a schematic diagram of the dishwasher 1 which has a washing container 2 for accommodating items to be washed, e.g. dirty dishes and cutlery, which is arranged for example in a top dishwasher basket 3 and a bottom dishwasher basket 4. Disposed in the washing container 2 are at least two spray devices which, in the case of the present exemplary embodiment, are embodied as upper and lower spray arms 5, 6 for the purpose of spraying the items to be washed with a liquid which is usually referred to as washing liquor. The liquid can be delivered by a circulating pump 7 via a first liquid feed line 8 to the upper spray arm 5 and via a second liquid feed line 9 to the lower spray arm 6. This is indicated in FIG. 2 by means of the arrows 21-23.

In the case of the present exemplary embodiment the liquid is heated at least in a subprogram step of a wash program of the dishwasher 1 by means of a throughflow heater 10 which is connected to the circulating pump 7 by means of an input port 11 and to the liquid feed lines 8, 9 by means of output ports 12, 13. The number of output ports 12, 13 corresponds to the number of spray arms 5, 6 or simultaneously operated groups of spray arms 5, 6. Accordingly, in the case of the present exemplary embodiment, the liquid delivered by the circulating pump 7 is routed to the input port 11 of the throughflow heater 10 and from its output ports 12, 13 via the liquid feed lines 8, 9 to the spray arms 5, 6.

The dishwasher 1 also has an electric drive 15, the electric motor of which drives the circulating pump 7 via a shaft 16. In the case of the present exemplary embodiment the motor of the electric drive 15 is a so-called BLDC motor, i.e. a brushless DC three-phase synchronous motor. The electric drive 15 additionally has a converter or inverter which supplies the electric motor of the electric drive 15 with electrical energy. The converter generates the necessary three-phase electric voltage for the motor, i.e. the necessary frequency and the necessary root mean square value of the electric voltage. Suitable converters have e.g. power semiconductors and are generally known to the person skilled in the art, for which reason the converter is not shown explicitly and also will not be explained in further detail.

The electric drive 15 is connected by means of an electric cable 17 to a control device 18 of the dishwasher 1 so that the control device 18 can control and if necessary also regulate the converter or, as the case may be, the electric drive 15 in a generally known manner. The control device 18 comprises e.g. a suitably programmed microprocessor and is generally provided to control the dishwasher 1 in such a way that the latter performs the wash program.

The control device 18 also receives information about at least one operating parameter of the electric drive 15 by way of the electric cable 17. The operating parameter of the electric drive 15 can be used e.g. for controlling or, as the case may be, regulating the electric drive 15. In the case of the present exemplary embodiment the operating parameter is the electric power output or the electric current of the electric drive 15.

In the case of the present exemplary embodiment the electric current of the electric drive 15 is used in order to detect the current position of a reversing device, in particular a water distributor 14, which is disposed e.g. in the throughflow heater 10 or is an integral part thereof. Alternatively, however, the water distributor 14 can also be disposed e.g. independently in the dishwasher 1 or connected directly to the circulating pump 7.

By means of the water distributor 14 the spray arms 5, 6 can be fed with the liquid alternately one at a time and/or constantly, which is achieved by opening one liquid outlet and by closing another liquid outlet of the water distributor 14. In the present exemplary embodiment the liquid outlets of the water distributor 14 transition directly into the output ports 12, 13 or are identical with the latter. The water distributor 14 also has a liquid inlet which, in the case of the present exemplary embodiment, is joined to the input port 11 or formed by same. In order to close the liquid outlets, in the case of the present exemplary embodiment, a valve body is adjusted by means of a drive, in particular an electric drive 19. The electric drive 19 is connected via an electric cable 20 to the control device 18 and is controlled by the latter. The electric motor of the electric drive 19 for the water distributor 14 is for example likewise a BLDC or BLAC motor and is controlled e.g. by a suitable converter or inverter, which in turn is controlled by the control device 18.

According to the position of the water distributor 14, i.e. according to the position of the valve body of the water distributor 14 moved by the electric drive 19, the circulating pump 7 delivers liquid only to the lower spray arm 6 but not to the upper spray arm 5, the circulating pump 7 delivers liquid only to the upper spray arm 5 but not to the lower spray arm 6, or the circulating pump 7 delivers liquid both to the upper spray arm 5 and to the lower spray arm 6. Owing to these different types of delivery of liquid, a different hydraulic load is generated at the circulating pump 7, which hydraulic load is, moreover, also characteristic of the individual positions of the water distributor 14.

The hydraulic loads at the circulating pump 7 that are dependent on the position of the water distributor 14 result e.g. also in a power consumption of the electric drive 15 for the circulating pump 7 that is dependent on the position of the water distributor 14. Generally, therefore, it is possible to deduce the position of the water distributor 14 on the basis of a suitably selected operating parameter of the circulating pump 7 or of the electric drive 15 driving the circulating pump 7.

In the case of the present exemplary embodiment, as already described hereintofore, the control device 18 receives the power output or, as the case may be, the electric current of the electric drive 15 as an operating parameter, with the result that, in the case of the present exemplary embodiment, the electric current of the electric drive 15 is already available to the control device 18 as a suitable operating parameter of the electric drive 15 for the purpose of deducing the current position of the water distributor 14. In order to deduce the position of the water distributor 14, electric current values assigned to the individual positions of the water distributor 14 are stored in a memory (not shown) of the control device 18, said current values corresponding to the current values of the electric current of the electric drive 15 driving the circulating pump 7 for the aforesaid positions of the water distributor 14. The current values are e.g. root mean square or maximum values.

In the case of the present exemplary embodiment the hydraulic load at the circulating pump 7 is greatest when both spray arms 5, 6 are charged with the liquid, and smallest when only the upper spray arm 5 is charged with liquid. If the circulating pump 6 delivers liquid only to the lower spray arm 6, then the hydraulic load at the circulating pump 7 lies between the hydraulic loads of the just cited positions of the water distributor 14. Therefore the electric current of the electric drive 15 driving the circulating pump 7 is greatest at a position of the water distributor 14 in which the circulating pump 7 delivers liquid to both spray arms 5, 6, and smallest at a position of the water distributor 14 in which the circulating pump 7 delivers liquid only to the upper spray arm 5. The electric current of the electric drive 15 driving the circulating pump 7 has a current value between the just cited current values at a position of the water distributor 14 in which the circulating pump 7 delivers liquid only to the lower spray arm 6.

During the operation of the dishwasher 1 the electric drive 19 moves the valve body of the water distributor 14, a process also referred to as passing through the water distributor position. At the same time the control device 18 or, as the case may be, a computer program running on the control device 18 compares the current values of the present electric current of the electric drive 15 driving the circulating pump 7 with the stored current values. On the basis of said comparison the control device 18 detects if the water distributor 14 has assumed a desired position, i.e. whether the circulating pump 7 is delivering liquid to the spray arms 5, 6 as desired based on the current position of the water distributor 14.

In the case of the described exemplary embodiment the electric current of the electric drive 15 for the circulating pump 7 is used for the purpose of detecting the position of the water distributor 14. Other operating parameters of the electric drive 15 are also suitable. Further suitable operating parameters are e.g. the torque, an electric voltage of the electric drive 15, for example the root mean square value of the electric voltage generated by the converter, or a rotational speed of the electric motor.

In the case of the described exemplary embodiment the dishwasher 1 comprises two spray arms 5, 6 which are charged with liquid by means of the circulating pump 7. Alternatively, however, the dishwasher 1 can also have a top-mounted shower 24 which is disposed e.g. on the ceiling of the washing container 2 and is connected via a liquid feed line (not shown) to the water distributor 14. This is indicated by means of an arrow 25 in FIG. 2.

What is claimed is:

1. A method for operating a dishwasher having a washing container, at least two spray devices disposed inside the washing container, a circulating pump to deliver liquid to the at least two spray devices, a first drive to drive the circulating pump, a reversing device, wherein, based on a position of the reversing device, the circulating pump delivers the liquid to at least one of the two spray devices, the method comprising:

adjusting the position of the reversing device; and detecting a current position of the reversing device based on an operating parameter assigned to the first drive.

2. The method of claim 1, wherein the operating parameter is a load magnitude of the circulating pump.

3. The method of claim 1, wherein the first drive is a first electric drive and wherein the operating parameter is at least one of an electric current, an electric voltage, an electric power output, a torque, and a rotational speed of the first electric drive.

4. The method as claimed in claim 3, further comprising at least one of controlling and regulating the first electric drive based on the operating parameter of the first electric drive.

5. The method of claim 1, further comprising adjusting the reversing device by a second drive.

6. The method of claim 5, wherein the second drive is a second electric drive.

7. The method of claim 1, further comprising adjusting the reversing device until detecting, based on the operating parameter, that the reversing device has assumed a desired position.

8. The method of claim 1, wherein during the adjusting of the reversing device, the operating parameter is compared with comparative values assigned to respective individual positions of the reversing device in order to detect the current position of the reversing device based on the operating parameter.

* * * * *